US011259128B2

(12) United States Patent
Mueller et al.

(10) Patent No.: US 11,259,128 B2
(45) Date of Patent: Feb. 22, 2022

(54) HEARING AID SYSTEM AND A METHOD FOR OPERATING A HEARING AID SYSTEM

(71) Applicant: Sonova AG, Staefa (CH)

(72) Inventors: Markus Mueller, Maennedorf (CH); Leo den Hartog, Zurich (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/412,453

(22) Filed: May 15, 2019

(65) Prior Publication Data

US 2019/0356994 A1 Nov. 21, 2019

(30) Foreign Application Priority Data

May 16, 2018 (DE) ..... 102018111742.6

(51) Int. Cl.
*H04R 25/00* (2006.01)
*H04R 1/10* (2006.01)
*H04R 25/02* (2006.01)

(52) U.S. Cl.
CPC ..... *H04R 25/554* (2013.01); *H04R 1/10* (2013.01); *H04R 25/50* (2013.01); *H04R 25/02* (2013.01); *H04R 25/65* (2013.01)

(58) Field of Classification Search
None
See application file for complete search history.

(56) References Cited

U.S. PATENT DOCUMENTS 8,625,830 B2 1/2014 Probst et al.
8,976,991 B2 3/2015 Feeley et al.
2009/0154739 A1* 6/2009 Zellner ..... H04R 1/1041 381/311
2011/0033073 A1* 2/2011 Inoshita ..... H04R 25/552 381/323
2012/0140967 A1* 6/2012 Aubert ..... H04R 25/656 381/325
2016/0044401 A1* 2/2016 Lee ..... H04R 1/1041 381/74
2016/0119708 A1* 4/2016 Rodzevski ..... H04R 1/1041 381/74
2016/0241968 A1* 8/2016 Hatanaka ..... H04R 25/602
(Continued)

FOREIGN PATENT DOCUMENTS

DE 102005006404 8/2006
DE 102009056719 6/2011
(Continued)

*Primary Examiner* — Qin Zhu
(74) *Attorney, Agent, or Firm* — ALG Intellectual Property, LLC

(57) ABSTRACT

The disclosed technology relates to a hearing aid system (HS) comprising a first hearing aid device (2), which is designed for arrangement in an ear canal (1.1), and a second hearing aid device (3), which is designed for arrangement near to the first hearing aid device (2), wherein the first hearing aid device (2) and the second hearing aid device (3) each comprise at least one microphone, one signal processing unit, one loudspeaker and one battery, such that both the first hearing aid device (2) and the second hearing aid device (3) can each function as a hearing aid device independently of the respective other of the hearing aid devices (2, 3). Furthermore, the disclosed technology relates to a method for operating the hearing aid system (HS).

15 Claims, 4 Drawing Sheets

(56) References Cited

U.S. PATENT DOCUMENTS

| | | | | |
|---|---|---|---|---|
| 2017/0055089 | A1* | 2/2017 | Pedersen | H04R 25/554 |
| 2017/0064830 | A1* | 3/2017 | Jiang | H05K 1/147 |
| 2017/0238087 | A1* | 8/2017 | Chawan | A45C 13/1069 381/380 |
| 2017/0280458 | A1* | 9/2017 | Lou | H04W 4/80 |
| 2018/0199140 | A1* | 7/2018 | Husung | H04R 25/652 |
| 2019/0082276 | A1* | 3/2019 | Crow | H04R 25/505 |
| 2019/0268706 | A1* | 8/2019 | Solum | A61B 5/6815 |

FOREIGN PATENT DOCUMENTS

| | | | |
|---|---|---|---|
| EP | 2417778 | B1 | 6/2015 |
| EP | 2663095 | B1 | 11/2015 |
| EP | 2293600 | B1 | 4/2017 |
| WO | WO 2011/031881 | A2 | 3/2011 |

* cited by examiner

HEARING AID SYSTEM AND A METHOD FOR OPERATING A HEARING AID SYSTEM

CROSS-REFERENCED PATENT APPLICATION

The present application claims priority to German Patent Application DE 10 2018 111 742.6 titled "Hearing Aid System and a Method for Operating a Hearing Aid System," which was filed May 16, 2018. The application is incorporated herein by reference in its entirety.

FIELD OF TECHNOLOGY

The disclosed technology relates to a hearing aid system comprising at least one hearing aid device which is designed for arrangement in an ear canal. Furthermore, the disclosed technology relates to a method for operating such a hearing aid system.

BACKGROUND

DE 10 2005 006 404 B3 discloses a hearing device system with an in-ear hearing device. In the in-ear hearing device a microphone, an amplifier and a loudspeaker are accommodated.

Moreover, EP 2 293 600 B1 discloses a hearing device. The hearing device comprises a processing unit which can be coupled to a receiver unit.

SUMMARY

The disclosed technology is based on the objective of specifying a hearing aid system which is improved in comparison with the prior art and an improved method for operating such a hearing aid system.

With respect to the hearing aid system, the objective is achieved according to the disclosed technology by means of the features specified in Claim 1. With respect to the method for operating a hearing aid system, the objective is achieved according to the disclosed technology by means of the features specified in Claim 15.

Implementations of the disclosed technology are the subject matter of the dependent claims.

A hearing aid system according to the disclosed technology comprises a first hearing aid device which is designed for arrangement in an ear canal. Furthermore, the hearing aid system comprises a second hearing aid device which is designed for arrangement near to the first hearing aid device, wherein the first hearing aid device and the second hearing aid device each comprise at least one microphone, one signal processing unit, one loudspeaker and one battery. In this context, both the first hearing aid device and the second hearing aid device can each function as a hearing aid device independently of the respective other of the hearing aid devices.

Also, the first and second hearing device can function as a single hearing device when combined. In a combined hearing device, some functions of the first and second hearing device will be deactivated such that the functions are not duplicated. For example, the combined hearing device may have only 1 active microphone, 1 active processing unit, or 1 active loudspeaker. Also, a processor may also be referred to as "processing unit" and the processor can be physically or electronically coupled to a memory. The memory can be a non-transitory computer readable medium storing instructions that can be executed by the processor (e.g., operations to operate the hearing device).

For example, the hearing system is a hearing aid device system. In this context, one of the hearing aid devices or both of the hearing aid devices can be embodied as a hearing device. In one implementation, the hearing aid system is embodied as a portable audio amplifier. Moreover, the hearing aid system can comprise headphones/earphones. For example, at least one of the hearing aid devices has additional functions, such as, for example, wireless connections to external units. In some implementations, a first hearing device may be an earpiece (e.g., earphone) and the second hearing device may be a hearing aid (e.g., designed to assist with hearing loss).

According to a further implementations of the hearing aid system, at least two functions, in particular a hearing aid function and an audio amplification function, can be combined with one another by means of a hearing aid function. For example, one of the two hearing aid devices of the hearing aid system has a hearing aid function, in particular a hearing device function. Furthermore, the other of the two hearing aid devices has an audio amplification function, in particular headphone function/earphone function. If both are then combined with one another, both functions can be combined with one another and can be used by one user.

In particular a compromise between the size and functionality is made possible. The user, in particular the person using and wearing the device, does not necessarily have to select between an invisible/discrete hearing aid system, in particular hearing aid device, and a relatively large visible hearing aid system, in particular hearing aid device. By means of the hearing aid system according to the disclosed technology, the user can wear a largely invisible/discrete hearing aid system which has a plurality of functionalities.

Furthermore, the hearing aid system is embodied, for example, in the form of a hearing device system, in particular as an in-ear hearing aid system, also referred to as ITE hearing aid system or IdO hearing aid system. In this context, the hearing aid devices of the hearing aid system are embodied in a discrete and small fashion. In particular, at least one of the two hearing aid devices is arranged in the ear, i.e. largely in the ear canal, when it is worn by the user. For example, this hearing aid device can be introduced to a greater extent deeply into the ear canal or else into an auditory passage of the user. The other of the two hearing aid devices is designed to project outside the ear canal, in particular auditory passage, and partially into the ear canal and can be worn by the user. For example, this hearing aid device is designed to rest in a region between the ear canal and the tragus. For example, the hearing aid device which is arranged in the ear canal comprises a flexible grip element or grip part for removing the hearing aid device. In this context, the grip element is arranged on the relatively small hearing aid device which fits into the ear canal, in such a way that the grip element does not affect a connection of the two hearing aid devices to form a hearing aid system. As a result, the grip element can be used to remove the hearing aid system even when the two hearing aid devices are connected.

In the text which follows, the hearing aid device which is arranged in the ear canal is referred to as the first hearing aid device or smaller hearing aid device. The second hearing aid device which is arranged near to the first hearing aid device and therefore rests partially in the ear canal and partially outside the ear canal is referred to as the larger hearing aid device.

In one implementation of the hearing aid system, the smaller hearing aid device is embodied as a self-supporting, fully functionally capable hearing aid device, in particular hearing device. For example, the smaller hearing aid device comprises at least one converter, such as for example a signal converter, at least one energy storage unit, such as for example a battery, in particular a secondary battery, and one signal processing unit. In this context, the smaller hearing aid device is, for example, what is referred to as an ITC (English abbreviation for: in-the-canal) hearing aid device. The smaller hearing aid device can be embodied as what is referred to as an instant fit hearing aid device, wherein the smaller hearing aid device can be inserted immediately and in a close-fitting fashion into the ear canal of the user. Furthermore, the smaller hearing aid device can comprise a shell or sheath which is not adapted or tailor-made or a housing which is not adapted. Alternatively, the smaller hearing aid device comprises an adapted, individually adapted or tailor-made shell or sheath, or an adapted, individually tailor-made housing. In this context, the smaller hearing aid device has the smallest possible design in order to permit maximum adaptation rate in an ear canal of different users and be basically invisible from the outside.

According to an implementation of the hearing aid system, the larger hearing aid device is arranged essentially in a region of the outer ear, in particular in a region of the outer ear and of an ear canal opening. The larger hearing aid device projects partially into the ear canal here in order to permit a connection to the smaller hearing aid device in a simple and compact fashion. In particular, the larger hearing aid device is embodied as what is referred to as an ITE (English abbreviation for: in-the-ear) hearing aid device. In this context, the larger hearing aid device is designed in such a way that it can optionally be connected to the smaller hearing aid device. A (larger) hearing aid device which is connected to the smaller hearing aid device and coupled thereto offers additional functionalities for the user and adapts itself in particular to a use requirement of the user.

For example, the functionalities comprise at least one of the functions specified below:

- function for improving a signal-to-noise ratio (also known as S/R or SNR or S/N),
- function with a directional audio characteristic or audio directionality (audio zoom),
- function for increasing the audiological power,
- function with a binaural connectivity or coupling possibility
  and/or
- function for a radio link, wireless data transmission link to a number of mobile peripherals, in particular mobile peripheral devices.

In a further embodiment of the hearing aid system, the second or larger hearing aid device comprises a larger number of microphones than the first or smaller hearing aid device. Alternatively or optionally, the battery of the second hearing aid device is designed to store a larger amount of energy than the battery of the first hearing aid device. For example, the first and smaller hearing aid device can be charged by means of the battery of the second and larger hearing aid device if both hearing aid devices are connected to one another. In particular, the first hearing aid device can be charged in the coupled state of the two hearing aid devices and while the hearing aid system is being used. In this context, there is no need for further intervention by the user. That is to say charging and/or exchange of energy takes place automatically. The second hearing aid device can be charged by means of an external charging device, in particular a charger. That is to say the battery of the first hearing aid device and/or the battery of the second hearing aid device can be recharged. Furthermore, the first hearing aid device is, for example, a hearing aid device with an extended length, in particular a hearing aid device which can be worn invisibly. In particular, a service life of the respective hearing aid devices can be increased significantly by virtue of the elimination of a main battery in the respective hearing aid devices.

According to an implementation of the hearing aid system means are provided for the wireless charging of the battery of the first hearing device by means of the second hearing device if the latter is arranged in a predefined position and/or at a proximal distance from the first hearing aid device.

According to one implementation of the hearing aid system, the second hearing aid device has an apparatus for the wireless reception of audio data. As a result, the user can communicate in a wireless fashion with external mobile terminals. For example, audio data from a music player, a mobile telephone and/or smartphone and/or some other terminal, such as for example a tablet or laptop, can be received.

A further embodiment provides that the hearing aid system comprises at least one control device and at least one means for detecting the second hearing aid device if the latter is arranged in a predefined position and near to the first hearing aid device. In this context, the control device is designed to establish a connection between the first and the second hearing aid devices. In particular, the control device is designed to at least partially deactivate the first hearing aid device when there is a connection, if the second hearing aid device has been detected. For example, the microphone which is arranged in the first hearing aid device can be deactivated. Alternatively or optionally, specific signal processing algorithms of the first hearing aid device can be deactivated. In this context, signal processing is carried out, for example, by the second hearing aid device, wherein subsequent information is transferred to the first hearing aid device. The first hearing aid device can generate a sound from the information and direct said sound in the direction of the user's eardrum. For example, for this purpose signal-processing means and/or signal-forwarding means and loudspeakers of the first hearing aid device remain active.

According to a further embodiment of the hearing aid system, the control device is designed to activate the second hearing aid device as soon as a connection between the first and the second hearing aid devices is detected, in particular is established or has been established.

In one implementation of the hearing aid system, the means for detecting the second hearing aid device comprises a capacitive sensor or a magnetic sensor. Alternatively or additionally, the means is designed to detect a feedback threshold, changed as a result of the arrangement of the second hearing aid device, between the microphone and the loudspeaker of the first hearing aid device.

In one implementation of the hearing aid system, the first hearing aid device and/or the second hearing aid device have/has a ventilation canal. For example, the first hearing aid device has a larger ventilation canal than the second hearing aid device. The first hearing aid device is therefore provided, for reasons related to the situation, for open adaptation or supply. Furthermore, the ventilation canal of the first hearing aid device is arranged in such a way that it serves as a sound canal for the loudspeaker of the second hearing aid device and is closed off it, i.e. is, in particular, closed off in an acoustically sealed fashion. For example, application, i.e. coupling of the second hearing aid device, is advantageous if the user finds himself in situations in which he is listening to music, making a telephone call or is subjected to loud noises, in particular ambient noises. For example, closed adaptation or supply is made possible by means of the second hearing aid device. In this context, in particular a high level of ventilation of the first hearing aid device by means of the second hearing aid device is at least partially (or completely) physically blocked.

According to an implementation of the hearing aid system, the ventilation canal of the first hearing aid device is arranged in such a way that it serves as a prolongation for the ventilation canal of the second hearing aid device if the latter is arranged in the predefined position and/or at a proximal distance from the first hearing aid device. In this context, the ventilation canal of the first hearing aid device is acoustically closed. Additionally or alternatively, an acoustic mass of the ventilation canal of the first hearing aid device can be modified by fitting on, i.e. coupling, the second hearing aid device.

In one implementation, the second hearing aid device is composed of at least one receiver or comprises at least one receiver, such as for example a dynamic receiver. As a result, the second hearing aid device can pass on sound through the ventilation canal of the first hearing aid device. In this end region or coupling region, the second, larger hearing aid device bypasses the first, smaller hearing aid device if the second hearing aid device is mounted on the first hearing aid device, with the result that the first hearing aid device changes its state, in particular its operating mode. For example, the first hearing aid device changes into a standby mode.

According to a further embodiment of the hearing aid system, the first, in particular smaller, hearing aid device and the second, in particular larger. hearing aid device are each embodied as standard devices. Furthermore, alternatively or additionally, the two hearing aid devices are embodied as devices which are adapted to an ear canal or auditory passage, i.e. to an anatomical shape of the ear canal or auditory passage. Additionally or optionally, either the first hearing aid device or the second hearing aid device is embodied as a standard device and the respective other hearing aid device is embodied as a device adapted to an ear canal or auditory passage of the user. For example, the respective hearing aid devices can be individually adapted to anatomical shapes of the ear canal, the opening of the ear canal, the tragus and/or the outer ear and manufactured.

In one implementation of the hearing aid system, the second hearing aid device is designed for arrangement in the auditory passage and/or for arrangement in an outer ear and/or for arrangement behind an outer ear.

A further embodiment of the hearing aid system provides that the first hearing aid device and/or the second hearing aid device are/is provided with at least one magnet and/or one mechanical connection in order to keep the second hearing aid device in the predefined position and/or at a proximal distance from the first hearing aid device.

According to one implementation, the mechanical connection is provided in order to assume two positions. In one position, the second hearing aid device is again detachable independently of the first hearing aid device. In a second position, the first hearing aid device can be removed from the ear canal by means of the second hearing aid device.

According to one developing embodiment, the first hearing aid device and/or the second hearing aid device are/is embodied in a self-orienting fashion. In particular, the self-orienting embodiment of the first and/or second hearing aid device is produced by means of magnetic force or some other frictionally locking and/or positively locking mechanical connection. For example, each of the hearing aid devices can comprise two or more magnets with opposing polarity or other connecting means, to control the orientation of the two hearing aid devices with respect to one another. In addition, when a mechanical lock is activated, the first hearing aid device can be removed from the ear together with the second hearing aid device.

Some implementations of the hearing aid system provide that at least one of the microphones of the second hearing aid device is embodied as a directional microphone. Alternatively or additionally, microphone signals can be processed in such a way that a directional effect is produced.

The advantages which result from the hearing aid system according to the disclosed technology comprise, for example, user friendliness for users. The hearing aid system can be used in a way which is simple, self-explanatory and uncomplicated for the user. By adding and making available an additional hearing aid device, a suitable hearing aid system can be ensured for specific application cases and situations in which, for example, a voice volume and speech volume have to be filtered as a result of noise and loud ambient sounds. In particular, the hearing aid system with a multiplicity of functions is invisible, i.e. it can be worn by the user in a way which largely cannot be seen by other persons. Furthermore, the second hearing aid device is configured visually in such a way that even when it is coupled to the first hearing aid device it is visually hardly perceptible or is conditionally or visually attractive.

In the method for operating the hearing aid system described above, the control device establishes a connection, in particular an automatic connection, between the hearing aid devices. By means of the control device, the first hearing aid device is at least partially deactivated if the means for detecting the second hearing aid device has detected the second hearing aid device in a predefined position and/or at a proximal distance from the first hearing aid device.

According to one implementation of the method, the second hearing aid device is activated by means of the control device.

One embodiment of the method provides that, in particular, a detection of imminent coupling of the two hearing aid devices takes place automatically. Moreover, switching over of an operating state of the respective hearing aid device takes place automatically. For example, the first hearing aid device in a non-coupled state to the second hearing aid device has full functions. When detection and coupling of the second hearing aid device occur, the instantaneous operating state (with full functions) is changed over, wherein the first hearing aid device changes into a standby mode and/or charging mode. In addition, specific functions are detected, i.e. reduced.

A mechanical interface between the two hearing aid devices is defined in a suitable way such that when the two hearing aid devices are coupled the ventilation canal of the first hearing aid device becomes the sound canal of the second hearing aid device, in particular a hearing aid device which is embodied as an add-on module.

In one implementation, for example one of the two hearing aid devices is manufactured as a standard device, while the other of the two hearing aid devices is adapted on a customer-specific and individual basis.

BRIEF DESCRIPTION OF FIGURES

Exemplary embodiments of the disclosed technology are explained in more detail below with reference to drawings, in which.

Parts which correspond to one another are provided with the same reference symbols in all the figures.

DETAILED DESCRIPTION

Figure 1:
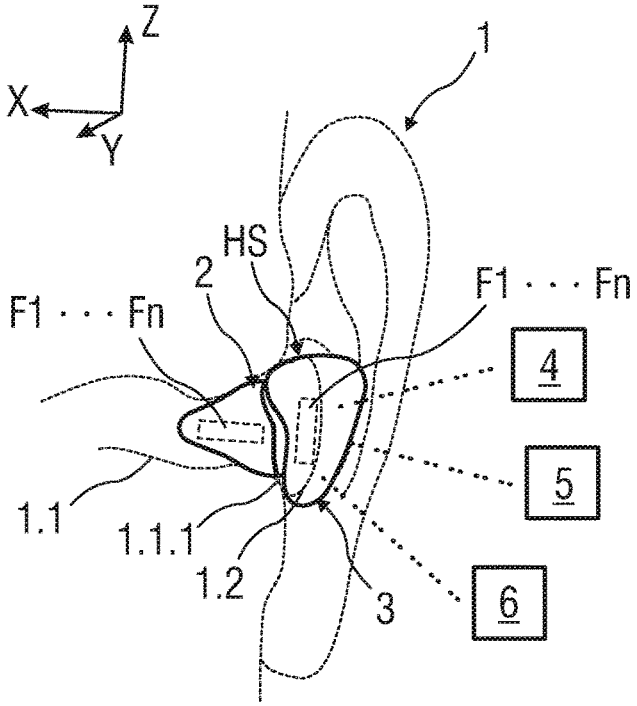
FIGS. 1 and 2 each show schematically a perspective view of an embodiment of a hearing aid system.
Figure 2:
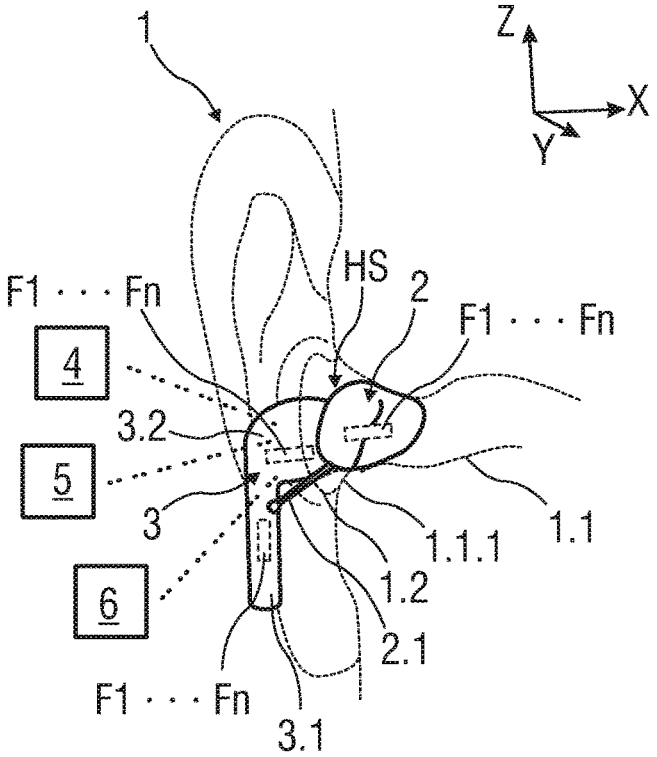

FIGS. 1 and 2 each show a hearing aid system HS which is arranged in an ear 1, for assisting the hearing of a user (not illustrated in more detail). The hearing aid system HS is, for example, a hearing device system. In particular, FIGS. 1 and 2 each show a different embodiment of the hearing aid system HS with generally the same main components, which will be described in more detail below.

For the sake of simplification of the following description, a coordinate system is depicted in each of the illustrated FIGS. 1 to 6, wherein an X axis corresponds to a longitudinal extent X of the hearing aid system HS, a Y axis corresponds to a transverse extent Y of the hearing aid system HS, and a Z axis corresponds to a vertical extent of the hearing aid system HS. The hearing aid system HS is introduced here, according to the longitudinal extent X, along a length of an ear canal 1.1 of a user, wherein the hearing aid system HS corresponds, according to the transverse extent Y, to a diameter of the ear canal 1.1.

The hearing aid system HS comprises a first hearing aid device 2, which is designed for arrangement in the ear canal 1.1. Furthermore, the hearing aid system HS comprises a second hearing aid device 3, which is designed for arrangement near to the first hearing aid device 2. In particular, the first hearing aid device 2 is what is referred to as an ITC or IdO hearing aid device 2. The second hearing aid device 3 is what is referred to as an ITE hearing aid device 3. In particular, the first hearing aid device 2 is arranged in the ear canal 1.1, and the second hearing aid device 3 projects partially into the ear canal 1.1, and is arranged between an ear canal opening 1.1.1 and a tragus 1.2.

For example, the first hearing aid device 2 is made smaller than the second, and therefore larger, hearing aid device 3.

In FIG. 1, the first hearing aid device 2 has smaller dimensions in the transverse extent Y and/or vertical extent Z. In the longitudinal extent X, the first hearing aid device 2 is made essentially longer than the second hearing aid device 3.

In FIG. 2, the first hearing aid device 2 has generally the same dimensions in the transvers extent Y, longitudinal extent X and in the vertical extent Z. In this context, the second hearing aid device 3 has a prolongation section 3.1, which protrudes approximately perpendicularly, in particular at an angle, from a main body 3.2 of the hearing aid device 3 and is connected thereto. Therefore, the prolongation section 3.1 has a larger dimension with respect to the vertical extent Z than the first hearing aid device 2.

Furthermore, the first hearing aid device 2 and the second hearing aid device 3 each comprise a number of functional units F1 to Fn. For example, the functional units F1 to Fn comprise a number of microphones, signal processing units, loudspeakers and batteries which are arranged in the first hearing aid device 2 and the second hearing aid device 3. In particular, the first hearing aid device 2 and the second hearing aid device 3 each comprise at least one microphone, one signal processing unit, one loudspeaker and one battery. The battery of the first hearing aid device 2 and/or the battery of the second hearing aid device 3 are/is rechargeable. In this context, both the first hearing aid device 2 and the second hearing aid device 3 can each function as a hearing aid device 2, 3, independently of the respective other of the hearing aid devices 2, 3.

For example, the prolongation section 3.1, illustrated in FIG. 2, of the second hearing aid device 3 comprises a plurality of microphones and is made to lead partially out of the ear 1, for example from an outer ear of the ear 1, for the sake of improved signal reception. The battery is arranged, for example, in the main body 3.2 of the second hearing aid device 3. For example, the battery of the second hearing aid device 3 is designed to store a larger amount of energy than the battery of the first hearing aid device 2. For example, the second hearing aid device 3 has more installation space owing to larger dimensions, with the result that a larger battery can be arranged in the main body 3.2. Furthermore, the prolongation section 3.1 can comprise a ventilation canal.

Furthermore, the functional units F1 to Fn of the second hearing aid device 3 comprise an apparatus for the wireless reception of audio data. Furthermore, the hearing aid system HS comprises, i.e. the first and/or second hearing aid devices 2, 3 each comprise, a number of functional units F1 to Fn, which are embodied as a control device and as means for detecting the second hearing aid device 3. In particular, the control device and/or the detection means are/is configured in such a way that a connection is established between the first hearing aid device 2 and the second hearing aid device 3 if the second hearing aid device 3 is arranged in a predefined position and near to the first hearing aid device 2. In this context, at the same time the first hearing aid device 2 is at least partially deactivated if the second hearing aid device 3 has been detected. Moreover, the control device is designed to activate the second hearing aid device 3 as soon as a connection is established between the first and second hearing aid devices 2 and 3.

The means for detecting the second hearing aid device 3 comprises a capacitive sensor or a magnetic sensor or is designed to detect a feedback threshold, changed as a result of the arrangement of the second hearing aid device 3, between the microphone and the loudspeaker of the first hearing aid device 2.

Furthermore, the functional units F1 to Fn include at least one ventilation canal. The ventilation canal of the first hearing aid device 2 is arranged in such a way that it serves as a sound canal for the loudspeaker of the second hearing aid device 3 and is closed off by it in an acoustically sealed fashion if the second hearing aid device 3 is arranged in the predefined position and/or at a proximal distance from the first hearing aid device 2. The ventilation canal of the first hearing aid device 2 is arranged in such a way that it serves as a prolongation for the ventilation canal of the second hearing aid device 3 if the latter is arranged in the predefined position and/or at a proximal distance from the first hearing aid device 2.

According to one implementation, a wireless connection of the hearing aid system HS to external and/or mobile devices 4 to 6 can be established by means of the functional units F1 to Fn of the second hearing aid device 3. For example, the device 4 is a music playback device. The device 5 is, for example, a message communicating unit, such as, for example, in the form of a portable clock or a portable mobile phone. The device 6 is, for example, a further mobile terminal, such as for example a smartphone. Audio data, which can be communicated with the mobile and/or portable devices 4 to 6, are passed onto the hearing aid system HS by means of, in particular, a wireless radio link. These audio data are played back to the user by means of loudspeakers of the hearing aid system HS. In this context, further functional units F1 to Fn of the hearing aid system HS can comprise amplifier units for amplifying and/or passing on amplified audio signals and audio data. Moreover, functional units F1 to Fn comprise means for the wireless charging of the battery of the first hearing aid device 2 by means of the second hearing aid device 3 if the latter is arranged in the predefined position and/or at a proximal distance from the first hearing aid device 2.

Furthermore, the first hearing aid device 2 illustrated in FIG. 2 comprises a grip element 2.1, in particular in the form of a flexible grip element 2.1 or gripping clip. The first hearing aid device 2 can easily be removed from the ear canal 1.1 by means of the grip element 2.1. If the two hearing aid devices 2 and 3 are coupled to one another, the first and second hearing aid devices 2, 3 can be removed together from the ear 1 by means of the grip element 2.1. Additionally or alternatively, both hearing aid devices 2 and 3 can be removed from the ear 1 by means of the prolongation section 3.1.

Figure 3:
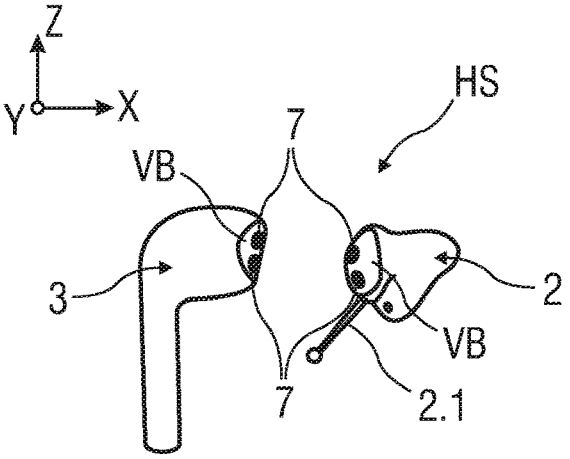
FIG. 3 shows schematically a perspective exploded illustration of an embodiment of the hearing aid system according to FIG. 2, FIGS. 4A to 4C each show schematically a perspective view of an embodiment of a hearing aid device of the hearing aid system, FIGS. 5A to 5C each show schematically a side view of an embodiment of hearing aid devices that are worn in the ear.

FIG. 3 shows a schematic exploded illustration of the hearing aid system HS according to FIG. 2. In particular, the first hearing aid device 2 and the second hearing aid device 3 have magnets 7 which respectively correspond to one another. In an alternative implementation, instead of the magnets 7, other mechanical connecting elements are provided. In particular, the magnets 7 are embodied in such a way that the second hearing aid device 3 is securely held in the predefined position and/or at a proximal distance from the first hearing aid device 2. Furthermore, ventilation canals can be arranged in connecting regions VB of the first and second hearing aid devices 2 and 3, which ventilation canals can be aligned with one another suitably and in a functionally capable fashion when the two hearing aid devices 2 and 3 are coupled.

Figure 4A:
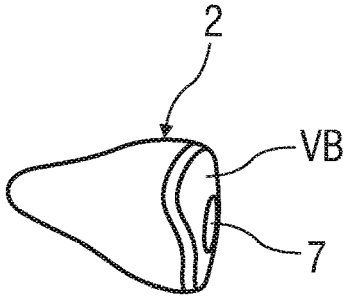
Figure 4B:
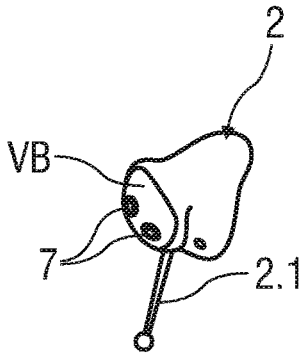
Figure 4C:
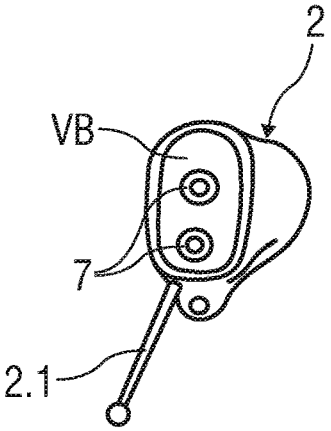

FIGS. 4A to 4C each show the first hearing aid device 2 of the hearing aid system HS. In particular, FIG. 4A shows the first hearing aid device 2 according to FIG. 1. FIGS. 4B and 4C each show the first hearing aid device 2 with a grip element 2.1 according to FIG. 2.

Figure 5A:
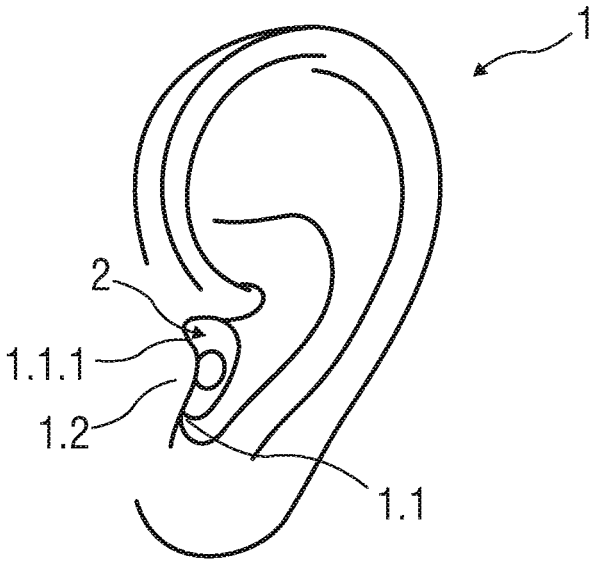
Figure 5B:
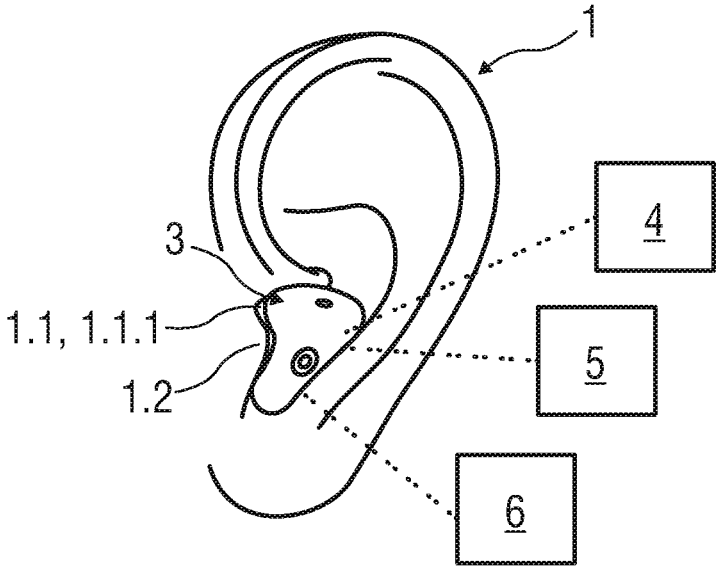
Figure 5C:
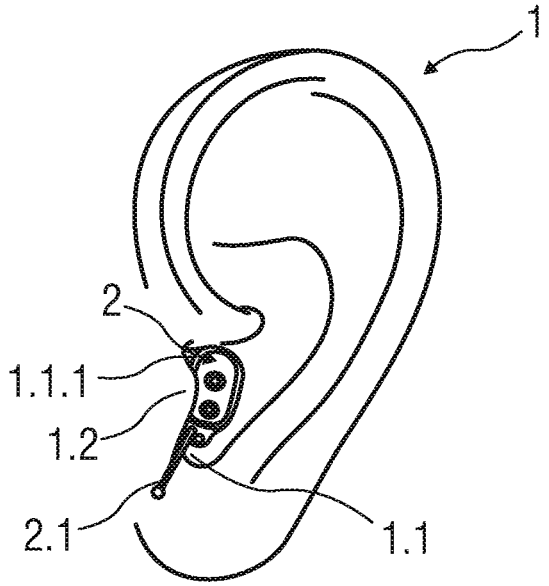

FIG. 5A shows schematically the first hearing aid device 2 which is arranged in the ear 1, in particular in the ear canal 1.1. FIG. 5B shows schematically the hearing aid system HS, arranged in the ear 1, with coupled hearing aid devices 2 and 3, wherein only the second hearing aid device 3 can be seen from the outside. FIG. 5C shows schematically the first hearing aid device 2, arranged in the ear 1, in particular in the ear canal 1.1, according to the hearing aid system HS in FIGS. 2 and 3.

Figure 6:
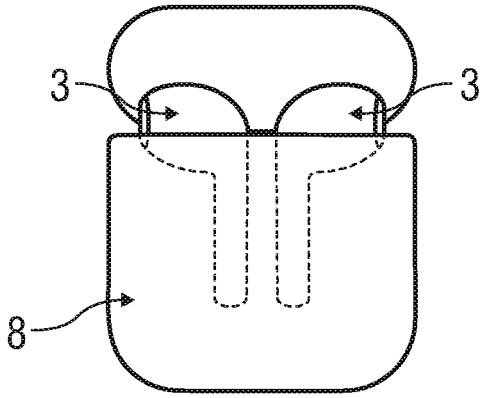
FIG. 6 shows schematically a perspective view of an embodiment of an apparatus for the arrangement of hearing aid devices.

FIG. 6 shows a perspective view of an embodiment of an apparatus 8 for the arrangement of hearing aid devices 2 and/or 3. For example, the apparatus 8 is a container or a storage device for the arrangement of the second hearing aid devices 3 (for the user's left and right ears 1). Furthermore, the apparatus 8 can alternatively or additionally be a charger for charging the second hearing aid devices 3.

LIST OF REFERENCE SYMBOLS

1 Ear
1.1 Ear canal
1.1.1 Ear canal opening
1.2 Tragus
2 (First) hearing aid device
2.1 Grip element
3 (Second) hearing aid device
3.1 Prolongation section
3.2 Main body
4 to 6 Devices
7 Magnet
8 Apparatus
F1 to Fn Functional units
HS Hearing aid system
VB Connecting region
X Longitudinal extent
Y Transverse extent
Z Vertical extent

We claim:

1. A hearing system comprising:

a first hearing device configured for arrangement in an ear canal of a first ear of a user; and a second hearing device configured for arrangement proximate to the first hearing device at the first ear of the user, wherein:

the first hearing device and the second hearing device each include a microphone, a signal processing unit, a loudspeaker, and a battery, such that both the first hearing device and the second hearing device are configured to function as a hearing device independently and when combined;

the loudspeaker of the first hearing device is provided in a portion of the first hearing device that is configured to be inserted within the ear canal of the first ear of the user;

the loudspeaker of the second hearing device is provided in a portion of the second hearing device that is configured for arrangement proximate to the ear canal of the first ear of the user when the first hearing device and the second hearing device are combined; and the first hearing device further includes a first ventilation canal that is configured to serve as a sound canal for the loudspeaker of the second hearing device when the first hearing device and the second hearing device are combined.

2. The hearing system according to claim 1, wherein at least one of:

the second hearing device includes more microphones than the first hearing device; or the battery of the second hearing device is configured to store more energy than the battery of the first hearing device.

3. The hearing system of claim 2, wherein the second hearing device further includes an apparatus for wireless reception of audio data.

4. The hearing system of claim 1, further comprising:

a control device; and a means for detecting the second hearing device if the second hearing device is at least one of: arranged in a predefined position or near to the first hearing device, wherein the control device is configured to establish a connection between the first hearing device and the second hearing device and to at least partially deactivate the first hearing device if the second hearing device has been detected.

5. The hearing system of claim 4, wherein the control device is configured to activate the second hearing device as soon as the connection is established between the first hearing device and the second hearing device.

6. The hearing system of claim 4, wherein the means for detecting the second hearing device comprises one of a capacitive sensor or a magnetic sensor or is designed to detect a feedback threshold, changed as a result of an arrangement of the second hearing device, between the microphone of the first hearing device and the loudspeaker of the first hearing device.

7. The hearing system of claim 1, wherein:

the first ventilation canal of the first hearing device is closed off by the second hearing device if the second hearing device is at least one of: configured in a predefined position or at a proximal distance from the first hearing device.

8. The hearing system of claim 1, wherein:

the first hearing device and the second hearing device are each embodied as non-customized devices or as customized devices which are customized to an auditory passage of the user; or one of the first hearing device or the second hearing device is embodied as a non-customized device and a respective other hearing device of the first hearing device and the second hearing device is embodied as a customized device customized to the auditory passage of the user.

9. The hearing system of claim 1, wherein the second hearing device is configured at least one of: for arrangement in an auditory passage or for arrangement in an outer ear.

10. The hearing system of claim 1, wherein at least one of: the battery of the first hearing device or the battery of the second hearing device can be recharged.

11. The hearing system of claim 1, wherein the second hearing device is configured to wirelessly charge the battery of the first hearing device if the second hearing device is at least one of: arranged in a predefined position or at a proximal distance from the first hearing device.

12. The hearing system of claim 1, wherein at least one of the first hearing device or the second hearing device is provided with at least one of a magnet or a mechanical connection in order to keep the second hearing device at least one of in a predefined position or at a proximal distance from the first hearing device.

13. A method of operating a hearing system, the method comprising:

detecting that a first hearing device and a second hearing device are proximate to each other at a first ear of a user, the first hearing device and the second hearing device each including a microphone, a signal processing unit, a loudspeaker, and a battery;

activating, by a control unit, combined functionality of the first hearing device and the second hearing device such that the first hearing device and the second hearing device become a single hearing device at the first ear of the user; and deactivating a hearing device function of the first hearing device or the second hearing device such that the hearing device function is not duplicated by the first hearing device and the second hearing device, wherein:

the loudspeaker of the first hearing device is provided in a portion of the first hearing device that is configured to be inserted within an ear canal of the first ear of the user;

the loudspeaker of the second hearing device is provided in a portion of the second hearing device that is configured for arrangement proximate to the ear canal of the first ear of the user when the first hearing device and the second hearing device are combined; and the first hearing device further includes a ventilation canal that is configured to serve as a sound canal for the loudspeaker of the second hearing device when the first hearing device and the second hearing device are combined.

14. The method of claim 13, wherein detecting the first hearing device and the second hearing device is based on at least one of the following:

a physical coupling of the first hearing device and the second hearing device to each other;

a distance between the first hearing device and the second hearing device;

an electronic coupling of the first hearing device and the second hearing device to each other; or electric or magnetic field detection.

15. The method of claim 13, wherein the hearing device function is at least one of the following:

capturing sound with the microphone of the first hearing device or the second hearing device;

providing sound through the loudspeaker of the first hearing device or the second hearing device;

controlling the microphone of the first hearing device or the second hearing device with a processor; or controlling the loudspeaker of the first hearing device or the second hearing device with the processor.

* * * * *